United States Patent [19]

Plunkett

[11] 4,105,985

[45] Aug. 8, 1978

[54] LEAD ATTACHMENT MEANS AND METHOD FOR MAKING ELECTRICAL COILS

[75] Inventor: James P. Plunkett, West Dundee, Ill.

[73] Assignee: Coils, Inc., Huntley, Ill.

[21] Appl. No.: 771,686

[22] Filed: Feb. 24, 1977

[51] Int. Cl.[2] ..... H01F 15/10

[52] U.S. Cl. ..... 336/90; 336/192; 339/275 R

[58] Field of Search ..... 336/198, 208, 192, 209, 336/90, 92; 339/275 A, 275 C, 275 R, 147 C, 198 C, 218 C, 278 A, 221 M; 310/71

[56] References Cited

U.S. PATENT DOCUMENTS

| | | | |
|---|---|---|---|
| 3,315,198 | 4/1967 | Biesma et al. | 336/192 |
| 3,423,711 | 1/1969 | Woods et al. | 336/192 |
| 3,453,575 | 7/1969 | Davis | 336/198 X |
| 3,609,616 | 9/1971 | Dumeige | 336/208 X |
| 3,634,878 | 1/1972 | Davis | 336/198 X |
| 3,663,914 | 5/1972 | Lane | 336/192 |
| 3,932,828 | 1/1976 | Plunkett et al. | 336/192 X |
| 3,963,857 | 6/1976 | Reynolds et al. | 336/192 X |

*Primary Examiner*—Thomas J. Kozma
*Attorney, Agent, or Firm*—Dressler, Goldsmith, Clement, Gordon & Shore, Ltd.

[57] ABSTRACT

An electrical coil including a flanged bobbin having a coil of wire wound thereon is disclosed herein. The bobbin has a terminal block secured to one flange which supports a pair of terminal leads. The terminal block also has a separate peg element for each terminal lead and the peg elements as well as the ends of the wire are respectively soldered to the terminal leads to secure the ends of the wire to the respective leads and securely retain the terminal leads on the block.

6 Claims, 6 Drawing Figures

LEAD ATTACHMENT MEANS AND METHOD FOR MAKING ELECTRICAL COILS

BACKGROUND OF THE INVENTION

The present invention relates to electrical coils consisting of a spool-like bobbin of molded plastic insulating material having many turns of fine wire wound thereon with a pair of terminal leads connected to opposite ends of the wire.

Since the field coil wire is very fine, on the order of 0.1 millimeter in diameter, one of the most difficult steps in the manufacture of electrical coils is the attachment of the fine wire to the larger lead wire and also maintaining the lead wire in a fixed position with respect to the bobbin.

Normally this is accomplished by utilizing a separate element or lug that is especially configured to receive a terminal lead. Examples of such devices are disclosed in Foerster U.S. Pat. No. 3,359,520 and Dumeige U.S. Pat. No. 3,609,616. While this type of separate element provides a secure connection for connecting terminal leads to a bobbin structure, the overall cost of assembling such a unit is extremely high since the lugs must be manufactured separately and then attached to the bobbin structure.

Attempts have been made to provide a connection between the lead wire and the field coil wire which do not require separate elements. Examples of this type of connection are shown in Biesma et al. U.S. Pat. No. 3,315,198; Davis U.S. Pat. No. 3,544,940; and Davis U.S. Pat. No. 3,660,791.

While these types of connections may be satisfactory in terms of providing a rigid securement of the terminal leads to the ends of the fine wire, difficulties have been encountered in utilizing such connecting means on automatic winding machinery since they either require the use of the separate element or many complicated steps in producing the connection.

SUMMARY OF THE INVENTION

The present invention provides an extremely simple connection between a terminal lead and the end of a fine coil of wire which is wound upon a bobbin. The unique connection also provides proper securement of the terminal lead to the bobbin which is capable of withstanding substantial pulling forces on the terminal leads without separation from the bobbin.

More specifically, the electrical coil assembly includes a bobbin which has a central portion and a pair of spaced parallel flanges extending from the central portion and one of the flanges has a terminal block supported thereon. The terminal block has a pair of parallel elongated openings extending therethrough which receive terminal leads that have exposed conductor portions located in the space between the flanges and connected to exposed ends of the fine wire. The connection means also includes peg means in the form of a metallic element that extends from the terminal block adjacent each exposed conductor portion and is secured thereto.

In the illustrated embodiments, the metallic element consists of a slender rod which is supported in a hole in the terminal block and extends in juxtaposed relation to the conductor portion of the terminal lead.

The peg means or metallic elements are also utilized as support means for the wire during the assembly of the bobbin, fine wire and terminal leads. In the method aspect of the invention, the metallic elements are initially positioned to extend generally parallel to the flanges at a location outside of the space between the flanges. One end of the field coil of fine wire is attached to one of the metallic elements and the fine wire is then wound onto the central portion of the bobbin. The opposite end of the fine wire is then connected to the other metallic element and the two metallic elements are then bent approximately 90° to extend into the space between the flanges. The terminal leads are then inserted through the respective openings and have their exposed conductor portions located in juxtaposed relation to the respective metallic elements. The metallic elements, conductor portions and the respective ends of the fine wire are then simultaneously soldered to each other to provide the final connection between the wire and the terminal lead.

In order to insure that the two terminal leads do not make contact with each other, insulating means are provided between the two terminals. In the specific embodiment illustrated, the insulating means is in the form of a divider that extends from the inner surface of a cover member which is adapted to extend across one of the flanges and be in engagement with the other flange, the flange having the terminal block thereon. The divider insures that the two terminal leads never contact with each other.

DETAILED DESCRIPTION

Figure 1:
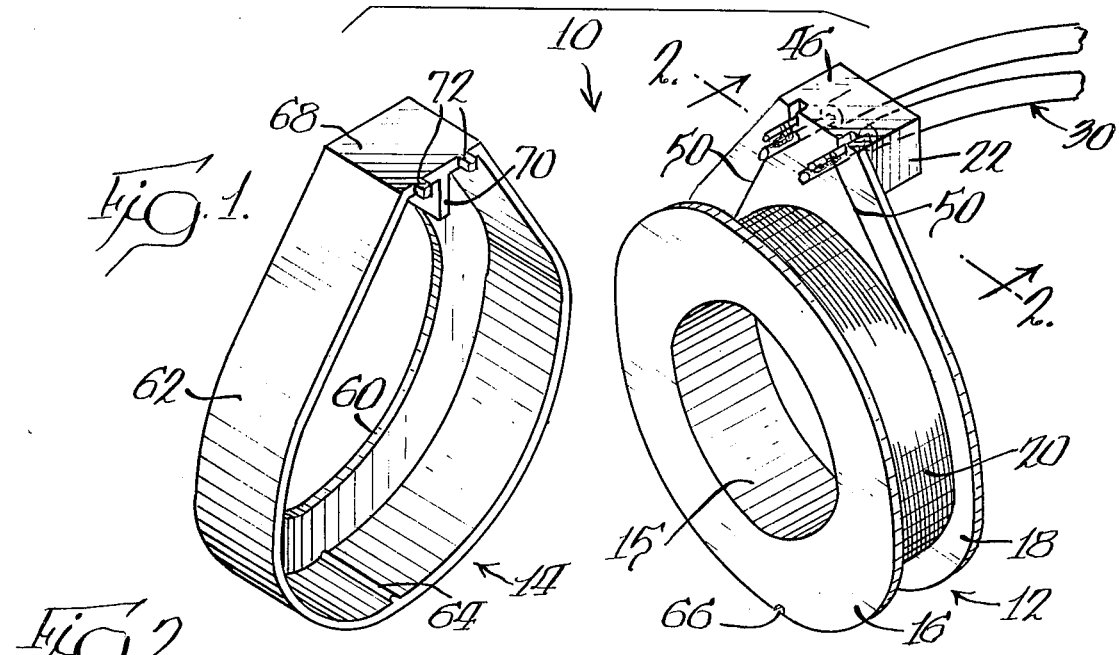
FIG. 1 is a perspective view of the electrical coil and cover that is associated therewith.
Figure 2:
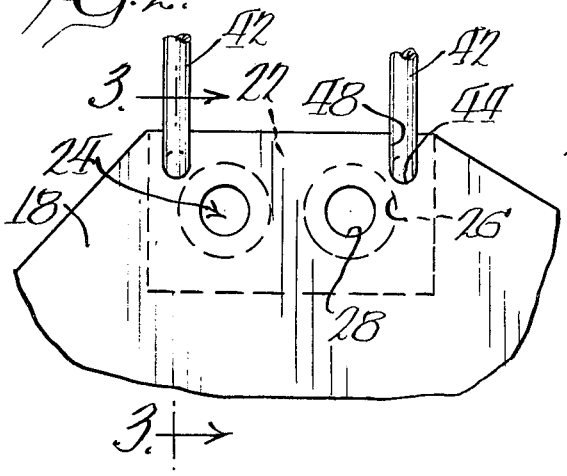
FIG. 2 is a fragmentary plan view, as viewed along line 2—2 of FIG. 1.

While this invention is susceptible of embodiment in many different forms, there is shown in the drawings and will herein be described in detail preferred embodiments of the invention with the understanding that the present disclosure is to be considered as an examplification of the principles of the invention and is not intended to limit the invention to the embodiments illustrated.

FIG. 1 of the drawings generally illustrates an electrical coil 10, which includes a bobbin 12 and a cover 14. Bobbin 12 includes a central portion 15 having a pair of flanges 16 and 18 extending therefrom to produce a generally U-shaped channel having a coil of wire 20 received therein.

Flange 18 has a terminal block 22 integral therewith with terminal block 22 having a pair of spaced parallel elongated openings 24 extending therethrough as well as through the supporting portion of flange 18. Each opening 24 has an enlarged portion 26 and a reduced portion 28. Enlarged portion 26 has a diameter that is equal to the outer diameter of terminal lead 30 that includes a central conductor portion 32 and a surrounding insulating portion 34. Insulating portion 34 is removed adjacent one end so that conductor portion 32 is exposed and is received through reduced portion 28 of opening 24, for a purpose that will be described later.

Figure 4:
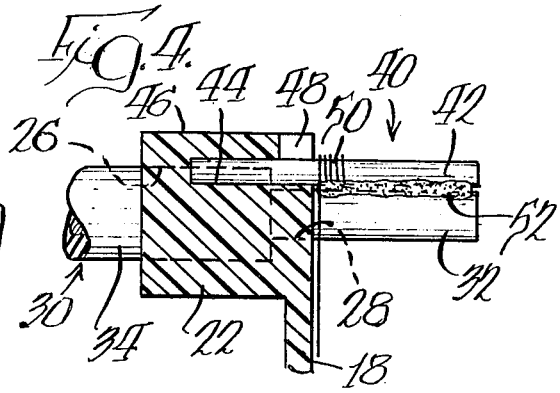
FIG. 4 is a view similar to FIG. 3 showing a separate element in its final position and the connection between the element and the conductor portion of the terminal lead.

As most clearly shown in FIG. 4, the enlarged portion 26 of opening 24 receives the insulating portion 34 of terminal lead 30 while the reduced portion 28 receives the conductor portion 32 of terminal lead 30. With this arrangement, the abutment between enlarged portion 26 and reduced portion 28 of opening 24 prevents insertion of terminal lead 30 beyond a certain point.

According to the present invention, terminal block 22 has peg means 40 extending therefrom and connected to exposed conductor portion 32 to securely retain terminal lead 30 on block 22. More specifically, peg means 40 consists of a metallic element or metal rod 42 that has one end received into a blind hole 44, which extends generally parallel to elongated opening 24 and is spaced therefrom. In the embodiment illustrated in FIGS. 3 and 4, the upper surface 46 of terminal block 22 has a slot 48 extending therefrom and the slot is joined at its inner end with hole 44, for a purpose that will be described later.

FIG. 4 of the drawings shows the final connection for separate element or peg means 40 to terminal lead 30 as well as one end 50 of wire 20. As most clearly illustrated in FIG. 4, separate element or metal rod 42 extends generally parallel to exposed conductor portion 32 and is in juxtaposed relation thereto so that metal rod 42 can be connected to conductor portion 32 as well as one end 50 of wire 20. This connection is preferably in the form of a soldered connection, as illustrated at 52.

One of the aspects of the present invention is that separate element 42 can be utilized as a wire support during assembly of electrical coil 12. Normally, in automatic winding machinery for producing coils of this type, the frame structure has a pair of pegs associated therewith so that one end of the fine wire 20 can be connected thereto and thereby retain one end of the wire with respect to bobbin 12 during the winding operation. Thereafter, the opposite end of the coil of wire 20 is secured to a second peg. With this arrangement, the opposite ends of wire 20 must be removed from the pegs and subsequently secured to the exposed conductor portions of the lead wires.

Figure 3:
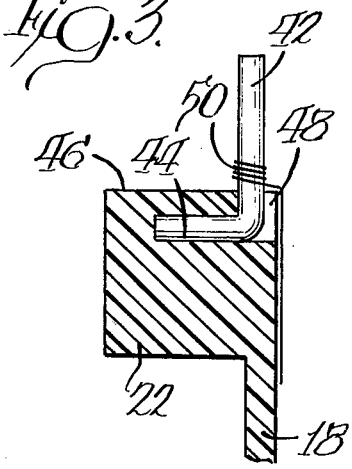
FIG. 3 is a fragmentary sectional view as viewed along line 3—3 of FIG. 2.

According to the present invention, metal rods or separate elements 42 are utilized in place of the separate pegs, as will now be explained in conjunction with the method aspect of the present invention. As illustrated in FIG. 3, metal rods 42 are initially bent intermediate opposite ends thereof to a substantially L-shaped configuration with intermediate portions extending through slots 48 so that the outer free end portions extend generally parallel to flange 18 and are spaced from the inner surface of flange 18. In this position, the channel between flanges 16 and 18 is unobstructed.

With the two metal rods 42 in the position illustrated in FIG. 3, one end 50 of fine wire 20 is wound around a first metal rod and may be secured thereto by soldering. The fine wire is then wound around central portion 14 between flanges 16 and 18 to produce a coil of wire. The second or opposite end 50 of wire 20 is then wound around the second metal rod 42 so that the wire is securely retained with respect to bobbin 12. Again, end 50 may be permanently secured to metal rod 42 by soldering.

The next step in assembling the electrical coil is to insert the two terminal leads 30 into the respective openings 24 so that conductor portions 32 are located in the space between the two flanges 16 and 18. Metal rods 42 are then bent approximately 90 degrees so that the rods extend generally parallel to and in juxtaposed relation with exposed conductor portions 32. Each metal rod 42, conductor portion 32 and end 50 of wire 20 may then be simultaneously interconnected and this interconnection is a soldered connection 52, as illustrated in FIG. 4. Of course, it will be appreciated that the metal rod 42 and exposed conductor portion 32 could also be interconnected by twisting the respective wires, particularly if the ends of wire 20 are initially soldered to metal rods 42.

The soldered connection insures that the terminal lead 30 cannot be separated from the remainder of the bobbin. This results from the fact that rod or wire element 42 provides a substantial amount of surface area to which the solder may adhere.

The complete bobbin assembly may then be encapsulated as described in U.S. Pat. No. 3,932,828, which is incorporated herein by reference. Alternatively, electrical coil 10 may have a cover as illustrated in FIG. 1.

Cover 14 consists of a flat annular wall portion 60 having a flange 62 extending from the periphery thereof. Flange 62 has a locating rib 64 that cooperates with a groove 66 in flange 16 to insure that cover 14 is accurately oriented with respect to bobbin 12. The upper flat wall portion 68 of flange 62 is adapted to be aligned with upper surface 46 of terminal block 22 and has a web portion 70 extending therefrom. Web portion or divider 70 is positioned on wall portion 68 so as to be located between the two exposed portions of terminal leads 30 to act as insulating means between the terminal leads. The exposed edge of wall portion 68 preferably also has a pair of projections 72 that are adapted to be received into slots 48 so that the cover acts as a complete seal for any conductor portions of the bobbin assembly.

Cover 14 may be permanently secured to bobbin 12 utilizing an adhesive for connecting the free edge of flange 62 to the inner surface of flange 18. The finished electrical coil 10 is completely sealed and terminal lead 30 cannot be separated from terminal block 22 without destruction of the entire unit.

Figure 5:
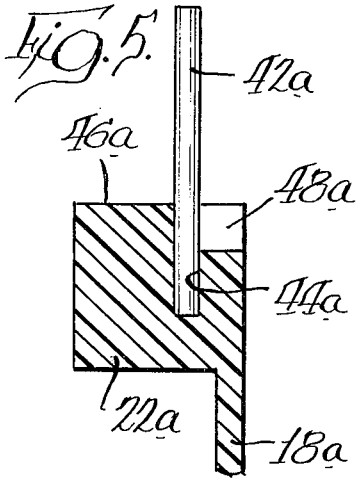
FIG. 5 is a view similar to FIG. 3 showing a slightly modified form of the invention.
Figure 6:
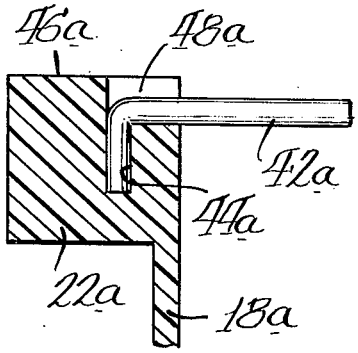
FIG. 6 is a view similar to FIG. 4 showing the separate element in its final position.

A slightly modified form of support for metal rods 42 is illustrated in FIGS. 5 and 6. In this embodiment, terminal block **22*a* has openings 44*a* which extend substantially perpendicular to elongated openings 24 and block 22*a* again has slots 48*a* extending from the upper surface 46*a* of the terminal block. In this embodiment, metal rods 42*a* are initially in a straight condition and are inserted into holes 44*a*, extending generally parallel to flange 18*a* but are spaced from the inner surface of the flange. In the embodiment illustrated in FIGS. 5 and 6, each metal rod 42*a* is bent to an L-shaped configuration illustrated in FIG. 6 after the coil of wire 20 has been wound onto central portion 14 of bobbin 12. In this position the free ends of rods are again in juxtaposed relation and extend parallel to conductor portions 32. The manner of securing metal rod 42*a* is the same as that described and shown in connection with FIG. 4**.

As can be appreciated from the above description, the present invention provides an extremely rigid interconnection between the terminal block and terminal leads so that the terminal leads cannot be separated from the terminal block without destruction of the entire unit.

While preferred embodiments have been shown and described, it will be appreciated that other modifications may be made without departing from the spirit of the invention. For example, if metal rods are not needed for supporting the opposite ends of wire 20 during the winding operation, the rods could be inserted into openings such as openings 44 after the coil of wire has been wound onto bobbin 12 and in such instance, slots 48 would not be necessary.

What is claimed is:

1. In an electrical coil including a bobbin having central portion and a pair of spaced parallel flanges extending radially from said central portion with a coil of wire wound upon said central portion between said flanges, said coil of wire having opposite free exposed ends, a terminal block extending from a surface of one flange and having a pair of elongated openings extending through said block and said one flange, said terminal block having a pair of holes respectively located adjacent the respective openings, a pair of terminal leads respectively received in said openings and each having an exposed conductor portion located between said flanges with said conductor portions respectively connected to respective free exposed ends of said wire, and a pair of metal rods respectively located in said holes and extending from said block to have free ends located between said flanges, said metal rods being located in juxtaposed relation to the respective exposed conductor portions and secured thereto to maintain said terminal leads in said openings.

2. An electrical coil as defined in claim 1, in which said holes extend substantially parallel to said openings.

3. An electrical coil as defined in claim 1, in which said block has slots extending from a surface thereof to said holes with a portion of said metal rods adapted to be received in the respective slots during winding of said coil of wire onto said central portion.

4. An electrical coil as defined in claim 1, in which said holes extend perpendicular to said openings and said block has a slot for each hole extending from a surface thereof to said hole and in which said metal rods are respectively located in said holes and said slots.

5. An electrical coil as defined in claim 1, further including insulating means between said terminal leads preventing contact with each other.

6. An electrical coil as defined in claim 5, further including a cover extending across the space between said flanges, said cover having a divider located between said terminal leads to define said insulating means.

* * * * *